United States Patent [19]

Marzoli

[11] 4,087,699

[45] May 2, 1978

[54] APPARATUS FOR MONITORING THE CONTINUITY OF A WEB IN A PROCESSING MACHINE

[75] Inventor: Angelo Marzoli, Bergamo, Italy

[73] Assignee: F.LLI Marzoli & C. S.p.A., Brescia, Italy

[21] Appl. No.: 706,842

[22] Filed: Jul. 19, 1976

[30] Foreign Application Priority Data

Jul. 22, 1975 Italy ..... 25639 A/75

[51] Int. Cl.[2] ..... H01H 83/00

[52] U.S. Cl. ..... 307/116; 307/326; 200/61.18; 19/.25

[58] Field of Search ..... 200/61.18, 61.13, 61.14, 200/61.15, 61.16, 61.17, 27.7, 61.41, 61.42, 46; 340/259; 242/55.15; 226/11, 43; 307/116, 326

[56] References Cited

U.S. PATENT DOCUMENTS

| | | | |
|---|---|---|---|
| 185,164 | 12/1876 | Bullough | 19/.25 |
| 1,018,029 | 2/1912 | Bell | 19/.25 |

*Primary Examiner*—Robert K. Schaefer
*Assistant Examiner*—Morris Ginsburg
*Attorney, Agent, or Firm*—Haseltine, Lake & Waters

[57] ABSTRACT

In a textile machine of the kind which processes a material in the form of a web or a gauze, a circuit for checking the continuity of said web or gauze, said circuit being branched off from the circuit which feeds the machine proper and ending in two terminals between which the web or gauze is caused to run, so that, when no web or gauze is interposed between said terminals, the branched off circuit is closed and electromagnetic means enter action to stop the machine.

4 Claims, 3 Drawing Figures

APPARATUS FOR MONITORING THE CONTINUITY OF A WEB IN A PROCESSING MACHINE

BACKGROUND OF THE INVENTION

This invention relates to a machine for checking the continuity of a fibre web, more particularly a gauze in a machine preparatory to spinning, such as for example a combing machine.

Apparatus of this kind is provided in combing machines for cotton in order to cause the machine stop in the case in which the feeding gauze is lacking.

The devices of the kind referred to above which are known for stopping the machine comprise, for example, lever feelers which detect the diameter of the gauze rollers as wrapped around a paperboard hub. The lever, as the gauze has been totally paid out, is capable of acting upon a switch which opens the power circuit of the machine and stops the latter.

The conventional devices are supposed to detect the instant of time at which the thickness of the gauze wrapped around the paperboard hub is reduced to nil. Actually, however, the start of the action of the device takes place well before, inasmuch as it is difficult to provide an adjustment which is capable of having the switch entering action as the unwrapping of the gauze is over.

This fact, of course, entails the drawback that material to be processed still remains on the paperboard hub as the machine is stopped. As soon as the hub is replaced by another hub which is filled, the machine which has been left on the former hub must thus be removed, that which is a loss both of production and time.

The conventional devices, moreover, do not enter action as an accidental interruption of the web takes place.

An object of this invention is to do away with the drawbacks outlined above while providing an apparatus which enters action only as the hub is completely emptied.

Another object of the invention is to provide a machine having an extremely simple structure which can be manufactured at a low cost.

SUMMARY OF THE INVENTION

These objects are achieved according to the invention by an apparatus for checking the continuity of the fibre web in a machine preparatory to spinning, characterized in that it is constituted by a circuit, branched off from the feeding circuit of the apparatus, said branched off circuit having two terminals yieldingly pressed to mutual contact and capable of affording a passageway for the web downstream of the hub around which the web is wrapped, said branched off circuit comprising a remote control mechanism which is adapted to open a switch of the feeding circuit as the two terminals come into mutual contact due to the absence of a web therebetween.

BRIEF DESCRIPTION OF THE DRAWINGS

With reference to the Figures of the accompanying drawings, an embodiment of the invention will be described hereinafter.

In the drawings.

DESCRIPTION OF THE PREFERRED EMBODIMENTS

Figure 1:
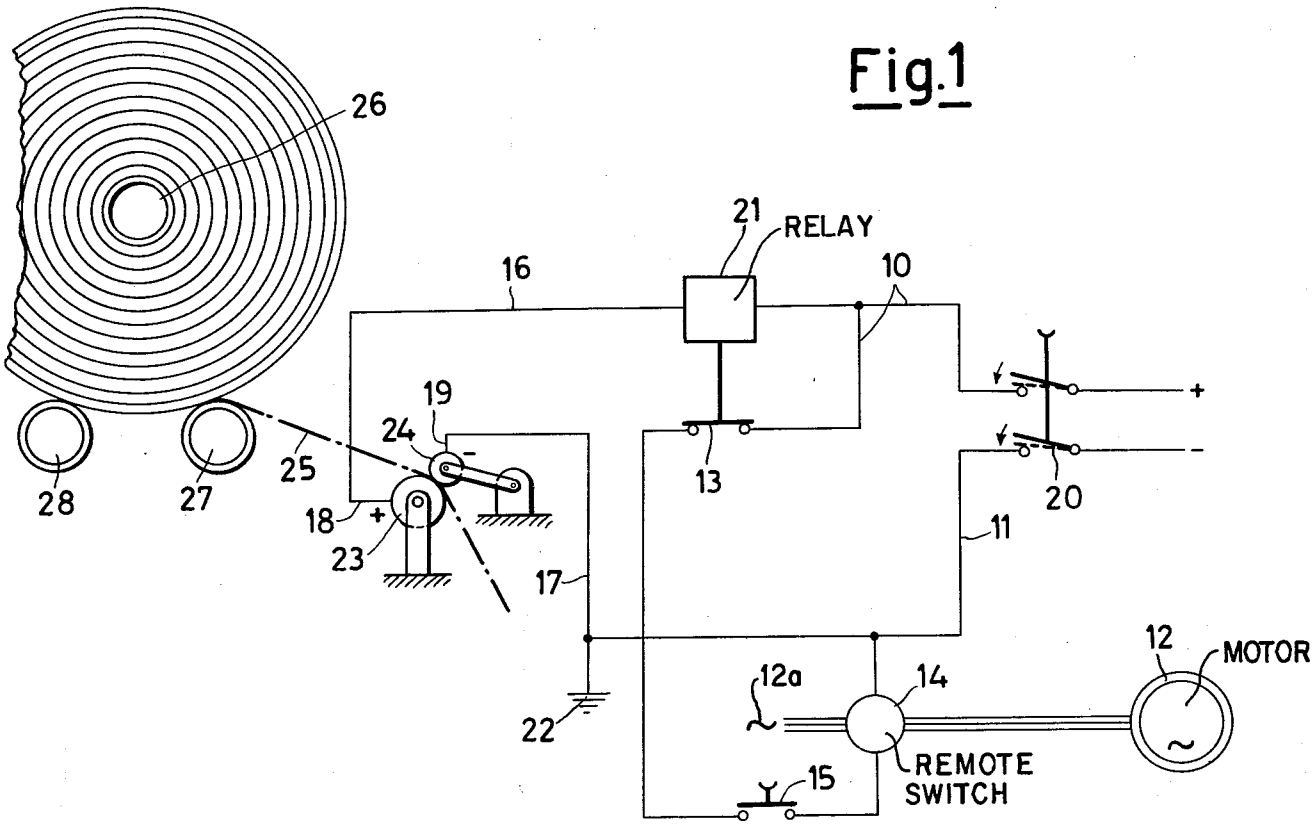
FIG. 1 shows a diagram of the apparatus according to this invention in its active position, as applied to a machine preparatory to spinning.
Figure 2:
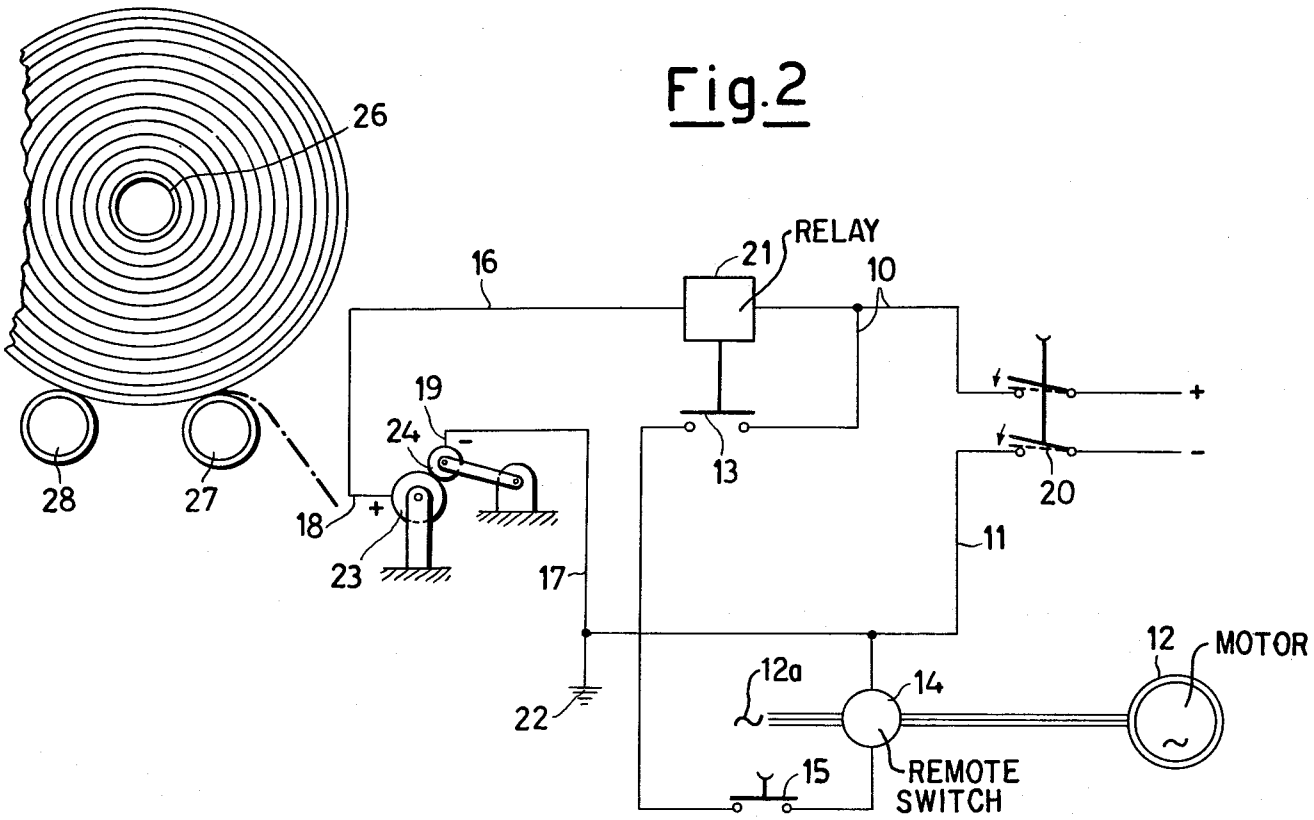
FIG. 2 is the counterpart of FIG. 1 but in the stopped position of the machine preparatory to spinning.

In FIGS. 1 and 2 a checking circuit 10–11 can be seen, of a motor 12 which actuates a machine preparatory to spinning, for example a combing machine.

In the line 10 of the checking circuit there are serially mounted a switch 13 and a manual switch 15 to drive the remote control switch 14 inserted in the feeding line of the motor 12.

A main switch 20 is mounted at the entrance to the circuit 10–11. From the circuit 10–11 a circuit 16–17 is branched off, which has terminals 18–19. In the branch 16 of the branch off circuit 16–17 a relay 21 is mechanically connected with the switch or contact 13. The branch 17, conversely, is grounded at 22. The terminals 18 and 19 are connected to cylinders 23 and 24 between which a web 25 is caused to pass. The web 25, in this case a gauze, is paid off from a paperboard hub 26 borne by cylinders 27 and 28.

Figure 3:
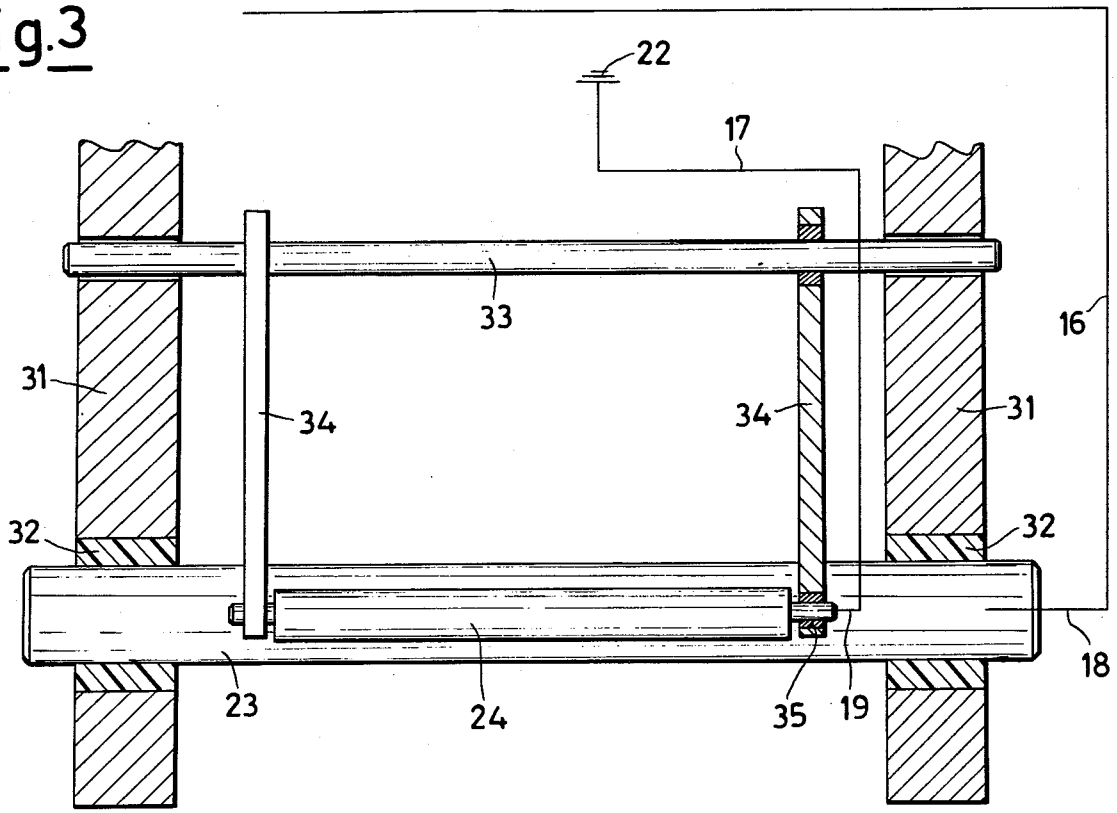
FIG. 3 is a cross-sectional view taken through a structual component part of the apparatus according to this invention.

FIG. 3 shows in detail the structure of the feeler member of the apparatus according to this invention, of which the cylinders 23 and 24 are an integral part. The cylinder 23 is made of an electrically conductive material and is supported by two uprights 31, relative to which is is insulated by bushings 32 of a dielectric material. The uprights 31, in addition, carry above the cylinder 23, a swinging bar 33 to which arms 34 are affixed, which support at their free ends the cylinder 24, so that the latter tends to bring itself into contact with the cylinder 23. The cylinder 24 is of an electrically conductive material and is supported for rotation at 35 on the arms 34. The cylinder 23 is connected to the terminal 18 and the cylinder 24 is connected to the ground by the terminal 19 or by the supporting member themselves. The relay 21 is so preset as to keep the switch 13 closed when the terminals 18 and 19 are open.

The operation of the apparatus according to the invention is as follows:

Let it be assumed that a web 25 unrolled from the hub 26 is passed between the two cylinders 23 and 24 to lead to the processing stations of a machine, for example a combing machine (not shown) driven by the motor 12. In this case the switches 13, 14, 15, 20 are closed and the cylinders 23 and 24 are not in mutual contact.

Let it be assumed that the web feed is discontinued, either because the hub 26 is empty or because the web has been broken. If so, the cylinders 23 and 24 enter a mutual contact and the electric current in the branched off circuit 16–17 energizes the relay 21 so that the switch 13 is opened; the coil of the remote switch 14 is no longer energized and stops the motor 12 so that the machine is also stopped. Switch 14 serves to connect or disconnect motor 12 from a 3-phase source 12*a*.

After the replacement of the hub with another full hub, in the case in which the web had totally been unrolled, or after having redressed the web breakage, the pushbutton 15 is depressed and the machine is started again.

The machine according to the invention could of course be employed also in machines other than combing machines.

What we claim is:

1. An apparatus for checking the continuity of a web, more particulary of a gauze, in a machine preparatory to spinning, such as a combing machine with a frame, comprising: a hub from which said web is unrolled, a branched off circuit having two terminals yielding pressed into electrical contact and providing a passageway for the web downstream of said hub from which the web is unrolled, a remote control switch driven by said branched off circuit responsive to the contact of said two terminals, a switch in the feeding circuit of the machine and opened by said remote control switch preparatory to spinning when said two terminals come into mutual contact due to absence of a web therebetween, a first cylinder connected to one of said terminals and fixedly supported on the machine, a second cylinder connected to the other terminal and movably supported so as to vary a gap between said cylinders, said second cylinder being electrically connected to ground potential, said cylinder fixedly supported on the machine being electrically connected to positive voltage potential, and insulating bushing means between the machine and the cylinder connected to positive potential for insulating the machine frame electrically.

2. An apparatus according to claim 1, wherein said remote control switch includes a relay having a mechanically actuated contact connected to said switch in said feeding circuit.

3. An apparatus according to claim 1, wherein one of said terminals is connected to said first cylinder of an electrically conductive material on which the web runs, said second cylinder being supported pivotably above said first cylinder so as to be movable to the latter.

4. An apparatus according to claim 1 wherein said remote control switch includes a relay having a mechanically actuated contact connected to said switch in said feeding circuit, one of said terminals being connected to said first cylinder of an electrically conductive material in which the web runs, said second cylinder being supported pivotably above said first cylinder so as to be moveable toward the latter, a motor in said feeding circuit for driving said machines, said relay being energized to open said remote control switch and disconnect said motor from an electrical alternating-current source.

* * * * *